US007959686B2

(12) United States Patent
Reynolds

(10) Patent No.: US 7,959,686 B2
(45) **Date of Patent: *Jun. 14, 2011**

(54) DRY-CLEANING ARTICLE, COMPOSITION AND METHODS

(75) Inventor: Rayvon E. Reynolds, Tucker, GA (US)

(73) Assignee: Dry, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/815,868

(22) Filed: Jun. 15, 2010

(65) Prior Publication Data

US 2010/0242185 A1 Sep. 30, 2010

Related U.S. Application Data

(63) Continuation of application No. 12/261,414, filed on Oct. 30, 2008, now Pat. No. 7,744,654, which is a continuation of application No. 11/986,416, filed on Nov. 21, 2007, now Pat. No. 7,446,083, which is a continuation of application No. 11/056,942, filed on Feb. 11, 2005, now Pat. No. 7,300,467, which is a continuation of application No. 09/737,613, filed on Dec. 13, 2000, now Pat. No. 6,855,172, which is a continuation-in-part of application No. 09/416,522, filed on Oct. 8, 1999, now Pat. No. 6,190,420, which is a continuation of application No. 09/170,755, filed on Oct. 13, 1998, now Pat. No. 5,965,504.

(60) Provisional application No. 60/170,747, filed on Dec. 14, 1999, provisional application No. 60/193,488, filed on Mar. 31, 2000, provisional application No. 60/193,679, filed on Mar. 31, 2000.

(51) Int. Cl.

| | |
|---|---|
| ***D06L 1/02*** | (2006.01) |
| ***C11D 3/18*** | (2006.01) |
| ***C11D 3/43*** | (2006.01) |

(52) U.S. Cl. ..... 8/142; 8/137; 510/277; 510/285; 510/286; 510/291; 510/295; 510/439

(58) Field of Classification Search ..... 510/277, 510/285, 286, 291, 295, 439; 8/137, 142
See application file for complete search history.

(56) References Cited

U.S. PATENT DOCUMENTS 3,261,185 A 7/1966 Rihr (Continued)

FOREIGN PATENT DOCUMENTS

EP 0479146 B1 12/1996

(Continued)

OTHER PUBLICATIONS

English language abstract of Japanese Patent No. JP 4-142398, 2003, May 15, 1992.

(Continued)

*Primary Examiner* — Brian P Mruk
(74) *Attorney, Agent, or Firm* — Dascenzo Intellectual Property Law, P.C.

(57) ABSTRACT

Dry cleaning and fabric-treatment compositions, methods and articles incorporating the same that are suitable for use in drying machines, such as hot air drying machines found in households, apartments, and laundromats, which are normally adapted to dry wet garments and the like from a washing machine. In some embodiments, the composition includes at least one organic solvent, with the at least one organic solvent forming the greatest weight percentage of the active components in the composition. In some embodiments, the composition also may include water and/or at least one surfactant, emulsifier, perfume, and/or application-specific composition. In some embodiments, the article includes a dispenser from which the composition is selectively dispensed onto a dry garment or other object to be cleaned. In some embodiments, the dispenser includes an internal chamber containing the composition, and the composition is dispensed onto objects prior to placing the objects in a drying machine.

22 Claims, 3 Drawing Sheets

U.S. PATENT DOCUMENTS

| | | | | |
|---|---|---|---|---|
| 3,432,253 | A | | 3/1969 | Dixon et al. |
| 3,593,544 | A | | 7/1971 | Henderson |
| 3,776,853 | A | | 12/1973 | Minter |
| 3,827,857 | A | | 8/1974 | Boulus |
| 3,907,496 | A | | 9/1975 | Néel et al. |
| 3,920,389 | A | | 11/1975 | Eanzel |
| 3,933,425 | A | | 1/1976 | Grünewälder et al. |
| 4,077,878 | A | | 3/1978 | Jackson |
| 4,176,080 | A | | 11/1979 | Wise et al. |
| 4,234,627 | A | | 11/1980 | Schilling |
| 4,336,024 | A | | 6/1982 | Denissenko et al. |
| 4,659,332 | A | | 4/1987 | Hellsten |
| 4,790,856 | A | | 12/1988 | Wixon |
| 5,082,466 | A | | 1/1992 | Rubenstein et al. |
| 5,196,132 | A | | 3/1993 | Mains et al. |
| 5,238,587 | A | | 8/1993 | Smith et al. |
| 5,442,938 | A | | 8/1995 | Kislyuk |
| 5,504,954 | A | | 4/1996 | Joo et al. |
| 5,547,476 | A | | 8/1996 | Siklosi et al. |
| 5,591,236 | A | | 1/1997 | Roetker |
| 5,630,847 | A | | 5/1997 | Roetker |
| 5,630,848 | A | | 5/1997 | Young et al. |
| 5,632,780 | A | | 5/1997 | Siklosi |
| 5,658,651 | A | | 8/1997 | Smith et al. |
| 5,681,355 | A | | 10/1997 | Davis et al. |
| 5,687,591 | A | | 11/1997 | Siklosi et al. |
| 5,746,776 | A | * | 5/1998 | Smith et al. ..... 8/142 |
| 5,762,648 | A | | 6/1998 | Yeazell |
| 5,789,368 | A | | 8/1998 | You et al. |
| 5,798,197 | A | | 8/1998 | Paulus et al. |
| 5,849,039 | A | | 12/1998 | Sadlowski |
| 5,858,022 | A | | 1/1999 | Romack et al. |
| 5,863,299 | A | | 1/1999 | Holt et al. |
| 5,869,410 | A | | 2/1999 | Smith et al. |
| 5,891,197 | A | | 4/1999 | Young et al. |
| 5,942,217 | A | | 8/1999 | Woo et al. |
| 5,942,484 | A | | 8/1999 | Roetker et al. |
| 5,965,504 | A | | 10/1999 | Reynolds |
| 5,968,404 | A | * | 10/1999 | Trinh et al. ..... 252/8.91 |
| 5,976,194 | A | | 11/1999 | Franzen |
| 5,997,759 | A | | 12/1999 | Trinh et al. |
| 6,001,343 | A | | 12/1999 | Trinh et al. |
| 6,013,614 | A | | 1/2000 | Mahdessian |
| 6,024,767 | A | | 2/2000 | Telesca et al. |
| 6,033,679 | A | | 3/2000 | Woo et al. |
| 6,036,727 | A | | 3/2000 | Smith |
| 6,045,588 | A | | 4/2000 | Estes et al. |
| 6,048,368 | A | | 4/2000 | Tcheou et al. |
| 6,171,346 | B1 | | 1/2001 | Yeazell et al. |
| 6,190,420 | B1 | | 2/2001 | Reynolds |
| 6,238,736 | B1 | | 5/2001 | Smith et al. |
| 6,243,969 | B1 | | 6/2001 | Yeazell |
| 6,254,932 | B1 | | 7/2001 | Smith et al. |
| 6,315,800 | B1 | | 11/2001 | Gomes et al. |
| 6,491,730 | B1 | | 12/2002 | Cauble, Jr. et al. |
| 6,855,172 | B2 | | 2/2005 | Reynolds |
| 7,262,159 | B2 | | 8/2007 | Nguyen et al. |
| 7,300,467 | B2 | | 11/2007 | Reynolds |
| 7,744,654 | B2 | * | 6/2010 | Reynolds ..... 8/142 |

FOREIGN PATENT DOCUMENTS

| | | |
|---|---|---|
| JP | 4-142398 | 5/1992 |
| JP | 7-324279 | 12/1995 |
| JP | 11-502887 | 3/1999 |
| WO | WO 96/30582 | 10/1996 |
| WO | WO 96/30583 | 10/1996 |
| WO | WO 96/39556 | 12/1996 |
| WO | WO 97/00738 | 1/1997 |
| WO | WO 97/20094 | 6/1997 |
| WO | WO 97/20099 | 6/1997 |
| WO | WO 99/16955 | 4/1999 |

OTHER PUBLICATIONS

English language abstract of Japanese Patent No. JP 7-324279, 2003, Dec. 12, 1995.

* cited by examiner

DRY-CLEANING ARTICLE, COMPOSITION AND METHODS

CROSS REFERENCE TO RELATED APPLICATIONS

This application is a continuation of and claims priority to similarly entitled U.S. patent application Ser. No. 12/261,414, which was filed Oct. 30, 2008 and issued on Jun. 29, 2010 as U.S. Pat. No. 7,744,654, and which is a continuation of U.S. patent application Ser. No. 11/986,416, which was filed Nov. 21, 2007, and issued on Nov. 4, 2008 as U.S. Pat. No. 7,446,083. U.S. Pat. No. 7,446,083 is a continuation of U.S. patent application Ser. No. 11/056,942, which was filed Feb. 11, 2005, and issued on Nov. 27, 2007 as U.S. Pat. No. 7,300,467. U.S. Pat. No. 7,300,467 is a continuation of U.S. patent application Ser. No. 09/737,613, now U.S. Pat. No. 6,855,172, which was filed Dec. 13, 2000, and issued on Feb. 15, 2005. U.S. Pat. No. 6,855,172 is a continuation-in-part of U.S. patent application Ser. No. 09/416,522, now U.S. Pat. No. 6,190,420, which is a continuation of U.S. patent application Ser. No. 09/170,755, now U.S. Pat. No. 5,965,504. U.S. Pat. No. 6,855,172 also claims priority to U.S. Provisional Patent Application Ser. No. 60/170,747, which was filed on Dec. 14, 1999 and to U.S. Provisional Patent Application Ser. Nos. 60/193,488 and 60/193,679, which were filed on Mar. 31, 2000. The complete disclosures of the above-identified patent applications are hereby incorporated by reference for all purposes.

FIELD OF THE INVENTION

This invention is directed generally to dry-cleaning compositions, articles and methods, and more particularly to dry-cleaning compositions, articles and methods for use with dryers, such as found in households and laundromats.

BACKGROUND OF THE INVENTION

U.S. Pat. No. 5,547,476 (hereinafter referred to as "the '476 patent," and the disclosure of which is hereby incorporated by reference) issued Aug. 20, 1996 to Siklosi et al. discloses a home dry-cleaning process. In the process of the '476 patent, a carrier sheet is releasably impregnated with a cleaning composition. The sheet and clothing to be cleaned are sealed in an air-tight bag that is placed in a dryer. As the dryer's drum heats and rotates, the sheet releases the cleaning composition to clean the clothes contained in the bag. The cleaning composition disclosed in the '476 patent includes water, etherfied propanol solvent, 1,2-octanediol, and an emulsifier. The specific requirement to use etherfied propanol solvent is disadvantageous in that there are many types of common garment stains that cannot be cleaned effectively with this substance. In addition, etherfied propanol can remove colors, particularly in garments made of silk. In addition, 1,2-octanediol is not a widely available substance, and the requirement that it be used in the composition of the '476 patent increases the cost of the composition. In addition, all embodiments of the '476 patent disclose water-based compositions in which water constitutes the largest constituent. Although such water-based compositions are effective in removing some types of garment stains, commonly occurring stains such as body or cosmetic oils are not effectively removed with water-based cleaning compositions, and such large amounts of water can remove color from garments.

U.S. Pat. No. 5,238,587 (hereinafter referred to as "the '587 patent," and the disclosure of which is hereby incorporated by reference) discloses a composite fabric-cleaning article including a flexible porous base sheet with a coating of a gelled cleaning composition. In a manner similar to the '476 patent, the sheet is placed in an air-tight bag with clothing, which is sealed and placed in a dryer. The composition includes about 60-90% water, about 0.25-5% gelling agent, about 2-32% of a water miscible organic solvent and about 5-10% surfactant. Thus, like the composition of the '476 patent, the composition of the '587 patent is water-based and accordingly relatively ineffective in cleaning garment stains caused by body or cosmetic oils, and such large amounts of water can remove color from some garments.

DETAILED DESCRIPTION AND BEST MODE OF THE INVENTION

Figure 1:
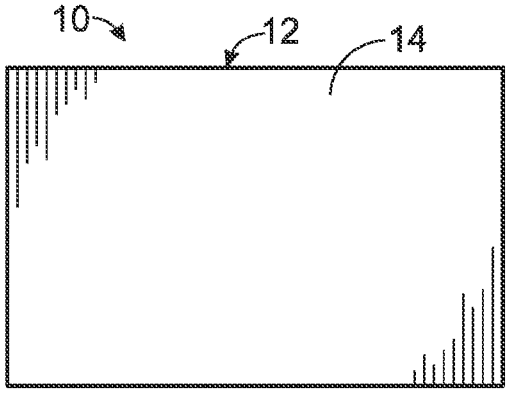
FIG. 1 is a plan view of a dry-cleaning article according to the present invention.

As discussed, the invented dry cleaning composition is an organic solvent-based composition in which an organic solvent forms the primary active constituent. Typically, the organic solvent will form at least 35% by weight of the composition, with a range of between approximately 51 wt % and approximately 98 wt % being preferred. The organic solvent may be any suitable organic solvent that effectively removes garment stains, and particularly oil-based garment stains, without damaging the garment being cleaned. Examples of suitable solvents include paraffins, olefins, acetylenes, siloxanes, acetates, chloro-fluorocarbons, glycols and mixtures thereof. One example of a suitable organic solvent is referred to in the chemical industry as "QED2," and is commercially available from Sentry Chemical, Inc. of Atlanta, Ga. QED2 organic solvent is particularly advantageous for use in the invention because it is safe for home use, i.e., it has relatively low toxicity, in contrast to other types of chemicals such as perchloroethylene ("perc") which is widely used in the dry-cleaning industry but which is toxic and therefore requires commercial equipment for containment.

Other suitable organic solvents include Exxon's ISOPAR™ line, including its ISOPAR V and ISOPAR M brands. Similarly, Exxon's NORPAR™ line may also be used, including its NORPAR 13 and NORPAR 15 brands. Still others include PARAFLEX HT-3 from PetroCanada, PB23 from Whittaker Oil, CALUMET 600 Solvent from Calumet Refining and PD-23 from Witco.

Unlike pert, or other toxic and/or carcinogenic chemicals that require specialized containment structures and safety procedures, the compositions according to the present invention are non-toxic in the percentages disclosed herein. Furthermore, they are not carcinogenic and may be used in dryers that operate at or near ambient pressures and which vent to the atmosphere. It should be understood that the invented compositions may be used in recirculating dryers, but a recirculating, or environmentally sealed, dryer is not required.

The invented dry-cleaning composition is also characterized by a water component, typically in the range of approximately 0 wt % and 40 wt % of the active components of the composition. It should be understood that the water component may form greater than 40 wt % of the dry-cleaning composition, such as between approximately 40 wt % and approximately 50 wt %; however, organic solvents will still form the greatest individual percentage of active ingredients in the composition, even with when the composition includes a significant water component. Typically, the organic solvents will form at least 50% by weight of all of the active components in the composition, and in many embodiments, the organic solvents will form at least 50% by weight of all of the components in the composition; however, it is within the scope of the invention that the organic solvents may form less than 50% by weight of the components of the composition but still be present is the greatest individual weight percentage of the active components in the composition. For example, the organic solvent or solvents may form 45% by weight of the active components of the composition, with water forming less than 45% by weight and the other active components collectively forming the remaining weight percentage. Preferably, the percentage of water in the composition is selected so that the water will readily stabilize when mixed with the other substances included in the invented composition. Compositions with approximately 30 wt % and less than 25 wt % have proven effective, although it should be understood that the optimum percentage of water used in a particular composition may vary depending upon the other components and relative percentages thereof in the composition.

The water in the composition serves several purposes. For one, water is effective in the removal of water-soluble stains from clothing, so its inclusion in the invented composition in limited amounts that will not remove significant color from garments is beneficial for this reason. Also, water is an effective agent in removing wrinkles from articles of clothing or other fabric items. Another factor which makes the inclusion of water beneficial in the invented composition is that organic solvents such as QED2 solvent ordinarily will ignite at relatively low temperatures, i.e., they generally have relatively low flashpoints. For example, QED2 solvent ignites at approximately 110° Celsius. The inclusion of water with the organic solvent in the invented composition is thus useful in raising the flashpoint of the composition so that it is much less likely to be accidentally ignited.

Because organic solvents and water are generally immiscible, the invented composition may include an emulsifier to promote mixing between the water and the selected solvent or mixture of solvents. The selected emulsifier may also include both nonionic and anionic components. In experiments, a percentage of emulsifier in the range of approximately 1 wt % and approximately 14 wt % has proven effective, with a mixture of 4 wt % nonionic emulsifier and 1 wt % anionic emulsifier being presently preferred. It should be understood, however, that the amount and makeup of emulsifier for a particular embodiment of the invented composition may tend to vary depending upon the particular substances and relative weight percentages thereof used in the composition. For example, the emulsifier may form less than one percent by weight of the active components in the composition, such as being present in the range of approximately 0.001 wt % and approximately 1 wt %, Similarly, it is within the scope of the invention that the emulsifier may form greater than 14 wt % of the active components in the composition.

The selected emulsifier, or combination of emulsifiers, should be selected to be suitable for use with the particular solvent in the composition, and not to degrade or react adversely to the operating conditions discussed herein. Examples of suitable emulsifiers include acrylates (e.g., acrylic acid, C10-30 alkyl acrylate crosspolymer, alkyl methacrylate copolymer), polyacrylic acid, carbomers (e.g., carboxyvinyl polymer), and oleyl alcohol 20 mole ethoxylate. Examples of anionic emulsifiers include substances commercially available under the trademarks PEMULEN™ and CARBOPOL™, and examples of nonionic emulsifiers include substances commercially available under the trademarks EMULIUN™ and EMULPHOR™. Such emulsifiers are commercially available from a large number of sources, including B.F. Goodrich Company of Richfield, Ohio, Stepan Company of Northfield, Ill., and Sentry Chemical Co. of Atlanta, Ga.

In addition to effectively removing oil-based and other stains from garments, the invented composition preferably has a flashpoint that is higher than the operating temperature of the dryer within which it will be used. For example, most household and commercial dryers operate at a temperature of approximately 60-70° C. (140-160° F.). Preferably, the invented composition has a flashpoint that is greater than approximately 150° F., preferably greater than 170° F. and even more preferably greater than 200° F. For example, the composition described herein has a flashpoint of approximately 232° F. Furthermore, it is nonflammable and noncombustable. Therefore, the invented composition, and articles produced therefrom, are safe for use in all household-type dryers, including compact dryers and higher-temperature dryers like those commonly used in laundromats, without requiring the use of a bag or other container to enclose the composition and articles during use. It should be understood that as used herein "household-type" dryers refers to conventional dryers used by consumers, such as in their homes, laundromats, etc., and may include various sizes, capacities and operating temperatures. For example, full size household dryers typically operate at temperatures between 140° F. and 160° F. and are designed to hold 15-20 pounds of articles to be dried, compact dryers typically operate at temperatures between 150° F. and 170° F. and are designed to hold approximately 10 pounds of articles to be dried, and dryers at laundromats typically operate at temperatures between 180° F. and 200° F., or more, and are designed to hold approximately 30 pounds of articles to be dried. Furthermore, when dryers that are designed to operate at temperatures greater than 200° F. often operate at temperatures above 200° F., such as temperatures in the range of approximately 200° F. and approximately 220° F., such as when not properly used and/or maintained.

Unlike the composition described herein, known water-based dry cleaning compositions have a flashpoint of approximately 105° F., which is lower than the operating temperatures of most household dryers. This limits the use of these compositions, generally requiring the composition or composition-impregnated sheet to be placed within an airtight bag or other container that prevents or effectively limits the flow of air to the composition. Even with this protective enclosure, these lower flashpoint compositions is not suitable for use in compact and most commercial dryers, thereby limiting the range of uses for these compositions to a subset of the entire market for these household dry-cleaning products.

As discussed, the invented composition includes one or more organic solvents and water, and typically will include some percentage of one or more emulsifiers. To increase the stain-removal capacity of the composition, it may include one or more surfactants. Anionic and nonionic surfactants have proven effective, typically in the range of approximately 0 wt % to approximately 5 wt %. An example of a suitable surfactant is nonyl phenoxy polyethoxy ethanol commercially available from Sentry Chemical of Atlanta, Ga. Others include Tergitol's N4, N8 and N9 brand of surfactants, as well as Stepan Chemical's Ninate 411 brand surfactant. Anther suitable type of surfactant is a fluorosurfactant, which offers the advantage that proportionally less of this surfactant is required to stabilize the emulsification between the organic solvent and water. For example, approximately 0.25 wt % to approximately 1 wt % has proven effective. One or more fluorosurfactants may be used in place of the other surfactants disclosed herein, or alternatively, as a cosurfactant with one of the other surfactants disclosed herein. An example of a suitable fluorosurfactant is available from DuPont and sold under the trade name Zonylfso™.

It may be desirable to include a perfume or other suitable scented substance to the composition itself, or to articles incorporating the composition. It should be understood that a suitable perfume will not react adversely with the other components of the composition and will not damage garments on which the composition is used. Any suitable scent may be selected, for example, depending upon the intended users of the composition. As an example, suitable scent-enhancing substances may be obtained from Ungurer, Inc. of Lincoln Park, N.J. When a perfume or other scent-enhancing substance is added to the composition, a percentage in the range of approximately 0 wt % and approximately 5 wt % has proven effective. It should be understood, however, that the amount of such a substance may vary and is not essential to the present invention. For example, the desirable amount to be used may vary upon such factors as user preferences, the strength of the particular substance to be added, etc.

The invented composition may also include a biocide, such as to protect against long-term degradation of the composition and to inhibit biological growth. Any suitable biocide or combination thereof may be used, so long as the overall effectiveness of the resulting composition is not impaired. Examples of suitable biocides include quaternary ammonium chloride and benzalkonium chloride. Typically, no more than a few percent of biocide is required, with experiments demonstrating that as little as 0.1 wt % biocide is sufficient. Of course, larger amounts may be used, subject to the conditions described herein.

The above-described dry-cleaning composition may also be adapted to specific applications, such as through the inclusion of an additional component or components, such as those described below. Alternatively, one or more of the above components may be replaced by one or more application-specific substances.

For example, the composition may include a solvent or combination of solvents specifically adapted for treating a certain type of stain. Commonly occurring stains for which specific formulations may be used include one or more of the following: ink, rust, red wine, food stains, and other beverage stains. Other materials that may be incorporated into the composition, either along with or in place of the above-described compositions, include one or more of the following: sizing, moth repellents, water repellents, UV-inhibitors, stain repellents, brighteners, dewrinklers and odor-removing substances, such as substances adapted to remove smoke, urine, and pet odors.

One suitable method for making the invented composition is by mixing appropriate amounts of the emulsifier with the water in a containment vessel using a glass rod or the like. The resulting mixture is poured into the organic solvent in another containment vessel while stirring until a stable emulsion forms. Generally, water is preferred to be used in the composition in a quantity sufficient that the mixture forms a stable emulsion upon mixing the solvent, water and emulsifier together. As discussed, a weight percentage of less than approximately 35% water has proven effective. If used, the perfume and surfactant can be mixed into the emulsion to finish the formulation of the invented composition.

As discussed above, the components of the invented composition may vary, as may the relative concentrations of the components. Regardless, the invented composition is always an organic-based composition, in which one or more organic solvents will form a primary percentage of the active components. For purposes of illustration, the following are illustrative compositions that have proven effective. It should be understood that each of these compositions may vary in components and composition, such as discussed above. When those variations eliminate a component, it should be understood that the compositions of the remaining components will be increased proportionately.

COMPOSITION #1

| Active Component | Wt % |
|---|---|
| Isopar V (organic solvent) | 63.6 |
| Ninate 411 (surfactant) | 3 |
| Diethyl Phthalate (emulsifier) | 2.75 |
| Water | 30 |
| Fragrance | 0.6 |
| Kathon (biocide) | 0.05 |
| Aminomethyl propanol (pH balancer) | 0.001 |

COMPOSITION #2

| Active Component | Wt % |
|---|---|
| Isopar M | 63.60 |
| Ninate 411 | 3.00 |
| Diethyl Phthalate | 2.75 |
| Fragrance | 0.60 |
| Water | 30.00 |
| Kathon | 0.05 |
| Aminomethyl Propanol | 0.001 |

COMPOSITION #3

| Active Component | Wt % |
|---|---|
| MINERAL Seal Oil (MSO)/ Kerr-Mac 600 | 75.23 |
| Ninate 411 | 0.27 |
| Nonylhenol-4 (N4) | 4.65 |
| Nonylhenol-8 (N8) | 0.99 |
| Diethyl Phthalate | 2.80 |
| Fragrance | 0.96 |
| Water | 15.05 |
| Kathon | 0.05 |
| Aminomethyl Propanol | 0.001 |

COMPOSITION #4

| Active Component | Wt % |
|---|---|
| Paraflex HT-3 | 75.23 |
| Ninate 411 | 0.27 |
| Nonylhenol-4 (N4) | 4.65 |
| Nonylhenol-8 (N8) | 0.99 |
| Diethyl Phthalate | 2.80 |
| Fragrance | 0.96 |
| Water | 15.05 |
| Kathon | 0.05 |
| Aminomethyl Propanol | 0.001 |

COMPOSITION #5

| Active Component | Wt % |
|---|---|
| PB23 | 75.23 |
| Ninate 411 | 0.27 |
| Nonylhenol-4 (N4) | 4.65 |
| Nonylhenol-8 (N8) | 0.99 |
| Diethyl Phthalate | 2.80 |
| Fragrance | 0.96 |
| Water | 15.05 |
| Kathon | 0.05 |
| Aminomethyl Propanol | 0.001 |

COMPOSITION #6

| Active Component | Wt % |
|---|---|
| Isopar V | 75.23 |
| Ninate 411 | 0.27 |
| Nonylhenol-4 (N4) | 4.65 |
| Nonylhenol-8 (N8) | 0.99 |
| Diethyl Phthalate | 2.80 |
| Fragrance | 0.96 |
| Water | 15.05 |
| Kathon | 0.05 |
| Aminomethyl Propanol | 0.001 |

COMPOSITION #7

| Active Component | Wt % |
|---|---|
| Isopar V | 50.88 |
| Isopar M | 12.72 |

-continued

COMPOSITION #7

| Active Component | Wt % |
|---|---|
| Ninate 411 | 3.00 |
| Diethyl Phthalate | 2.75 |
| Fragrance | 0.60 |
| Water | 30.00 |
| Kathon | 0.05 |
| Aminomethyl Propanol | 0.001 |

COMPOSITION #8

| Active Component | Wt % |
|---|---|
| Isopar V | 68.60 |
| Ninate 411 | 3.00 |
| Diethyl Phthalate | 2.75 |
| Fragrance | 0.60 |
| Water | 25.00 |
| Kathon | 0.05 |
| Aminomethyl Propanol | 0.001 |

COMPOSITION #9

| Active Component | Wt % |
|---|---|
| Paraflex HT-3 | 68.60 |
| Ninate 411 | 3.00 |
| Diethyl Phthalate | 2.75 |
| Fragrance | 0.60 |
| Water | 25.00 |
| Kathon | 0.05 |
| Aminomethyl Propanol | 0.001 |

COMPOSITION #10

| Active Component | Wt % |
|---|---|
| PB23 | 68.60 |
| Ninate 411 | 3.00 |
| Diethyl Phthalate | 2.75 |
| Fragrance | 0.60 |
| Water | 25.00 |
| Kathon | 0.05 |
| Aminomethyl Propanol | 0.001 |

COMPOSITION #11

| Active Component | Wt % |
|---|---|
| MSO | 68.60 |
| Ninate 411 | 3.00 |
| Diethyl Phthalate | 2.75 |
| Fragrance | 0.60 |
| Water | 25.00 |
| Kathon | 0.05 |
| Aminomethyl Propanol | 0.001 |

COMPOSITION #12

| Active Component | Wt % |
|---|---|
| Isopar V | 73.60 |
| Ninate 411 | 3.00 |
| Diethyl Phthalate | 2.75 |
| Fragrance | 0.60 |
| Water | 20.00 |
| Kathon | 0.05 |
| Aminomethyl Propanol | 0.001 |

COMPOSITION #13

| Active Component | Wt % |
|---|---|
| Paraflex HT-3 | 73.60 |
| Ninate 411 | 3.00 |
| Diethyl Phthalate | 2.75 |
| Fragrance | 0.60 |
| Water | 20.00 |
| Kathon | 0.05 |
| Aminomethyl Propanol | 0.001 |

COMPOSITION #14

| Active Component | Wt % |
|---|---|
| PB23 | 73.60 |
| Ninate 411 | 3.00 |
| Diethyl Phthalate | 2.75 |
| Fragrance | 0.60 |
| Water | 20.00 |
| Kathon | 0.05 |
| Aminomethyl Propanol | 0.001 |

COMPOSITION #15

| Active Component | Wt % |
|---|---|
| MSO | 73.60 |
| Ninate 411 | 3.00 |
| Diethyl Phthalate | 2.75 |
| Fragrance | 0.60 |
| Water | 20.00 |
| Kathon | 0.05 |
| Aminomethyl Propanol | 0.001 |

COMPOSITION #16

| Active Component | Wt % |
|---|---|
| Transcutol CG | 34 |
| Isohexadecane | 30 |
| N4 | 5 |
| N9 | 1 |
| Ninate 411 | 0.3 |
| Diethyl Phthalate | 2 |
| Water | 27 |
| Kathon | 0.05 |
| Fragrance | 0.6 |
| Tetrasodium | 0.05 |
| Citric Acid | 0.001 |

COMPOSITION #17

| Active Component | Wt % |
|---|---|
| Water | 45 |
| Tetrasodium Edta | 0.05 |
| Isopar M | 20 |
| Isopar V | 33 |
| Ninate 411 | 1 |
| Pemulen TR-2 | 0.15 |
| Triethanolamine | 0.15 |
| Kathon | 0.05 |
| Fragrance | 0.6 |

COMPOSITION #18

| Active Component | Wt % |
|---|---|
| Water | 45 |
| Tetrasodium Edta | 0.05 |
| Isopar M | 20 |
| Isopar V | 33 |
| Ninate 411 | 1 |
| Pemulen TR-2 | 0.15 |
| Triethanolamine | 0.15 |
| Kathon | 0.05 |
| Fragrance | 0.6 |
| Aminomethyl Propanol | 0.001 |

COMPOSITION #19

| Active Component | Wt % |
|---|---|
| Water | 45 |
| Tetrasodium Edta | 0.05 |
| Isopar M | 33 |
| Isopar V | 20 |
| Ninate 411 | 1 |
| Pemulen TR-2 | 0.15 |
| Triethanolamine | 0.15 |
| Kathon | 0.05 |
| Fragrance | 0.6 |
| Aminomethyl Propanol | .001% |

COMPOSITION #20

| Active Component | Wt % |
|---|---|
| Water | 45 |
| Tetrasodium Edta | 0.05 |
| Isopar M | 40 |
| Isopar V | 13 |
| Ninate 411 | 1 |
| Pemulen TR-2 | 0.15 |
| Triethanolamine | 0.15 |
| Kathon | 0.05 |
| Fragrance | 0.6 |
| Aminomethyl Propanol | 0.001 |

| COMPOSITION #21 | |
|---|---|
| Active Component | Wt % |
| Water | 43.25 |
| Tetrasodium Edta | 0.05 |
| Isopar M | 50 |
| Ninate 411 | 3 |
| Diethyl Phthalate | 2.75 |
| Pemulen TR-2 | 0.15 |
| Triethanolamine | 0.15 |
| Kathon | 0.05 |
| Fragrance | 0.6 |
| Aminomethyl Propanol | 0.001 |

| COMPOSITION #22 | |
|---|---|
| Active Component | Wt % |
| Water | 27 |
| Tetrasodium Edta | 0.05 |
| Isohexadecane | 30 |
| Transcutol | 34 |
| N4 | 5 |
| N9 | 1 |
| Ninate 411 | 0.3 |
| Diethyl Phthalate | 2.0 |
| Kathon | 0.05 |
| Fragrance | 0.6 |
| Citric Acid | 0.001 |

The article of this invention includes any suitable carrier or substrate the may be permeated with the invented composition. Examples of suitable carriers include permeable sheet-like materials, objects, containers adapted to hold a volume of the invented composition, and the like. For example, the composition may be contained in a dispenser, such as an aerosol, pump or pressurized spray bottle or vessel, which receives and stores in an internal chamber a volume of the composition for selective dispensing. Alternatively, the composition may be mixed with a suitable gelling agent or binder to form a solid object that may be manually applied, or dispensed, to the garments or other article to be cleaned, which may be placed in the dryer to tumble with the articles to be cleaned, or which may be fastened inside the drying compartment of the dryer. For purposes of discussion, the following description will describe an article in the form of a sheet, however, it should be understood that articles having other forms are within the scope of the invention so long as they include one or more of the invented compositions. As used herein, "permeated" is intended to broadly mean any suitable method for applying, infusing, absorbing, impregnating or otherwise preparing a substrate, such as the subsequently described sheets, to dispense one or more of the invented compositions, such as through contact with the garments or other objects to be cleaned.

In FIG. 1, a schematic illustration of a dry-cleaning article according to the present invention is generally indicated at 10. Article 10 includes a substrate 12, such as a sheet-like material, permeated with the invented composition, which is generally indicated at 14. Alternatively, the same or different portions of the sheet can be permeated with organic solvent and water, and optionally also perfume and surfactant.

In some embodiments, it may be desirable to permeate some regions of the sheet may be permeated with one embodiment of the composition, with one or more other region being permeated with at least one other embodiment. For example, a portion of the sheet may include an all-purpose composition according to the above-description, with one or more other portions including one or more specialized compositions, such as to treat a specific type of stain or to protect against a certain type of damage. For example, the sheet may provide an organic-based dry-cleaning composition while also providing a moth repellent, water repellent, stain repellent, brightener and/or UV-inhibitor.

Figure 2:
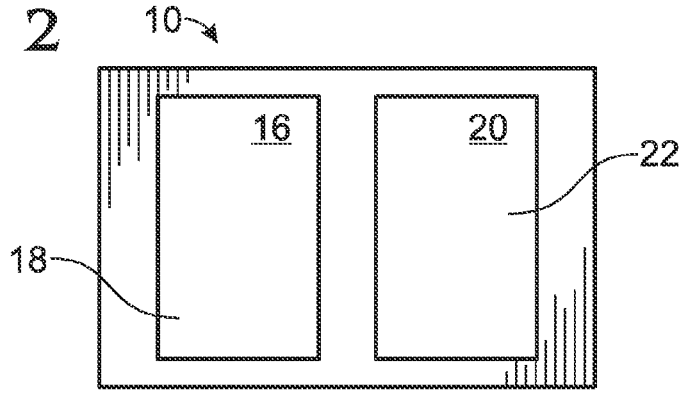
FIG. 2 is a plan view showing another embodiment of the article of FIG. 1.
Figure 3:
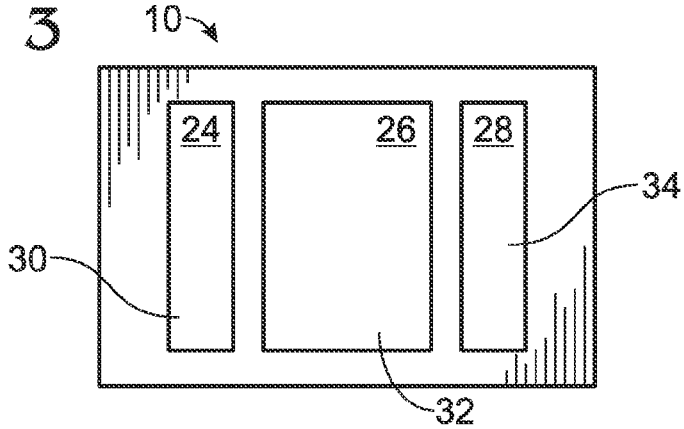
FIG. 3 is a plan view showing another embodiment of the article of FIG. 1.
Figure 4:
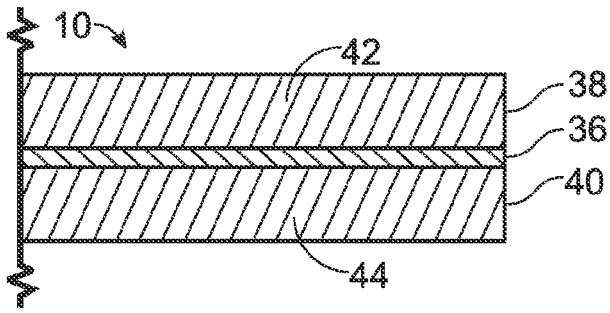
FIG. 4 is a cross-sectional view showing another embodiment of the article of FIG. 1.
Figure 5:
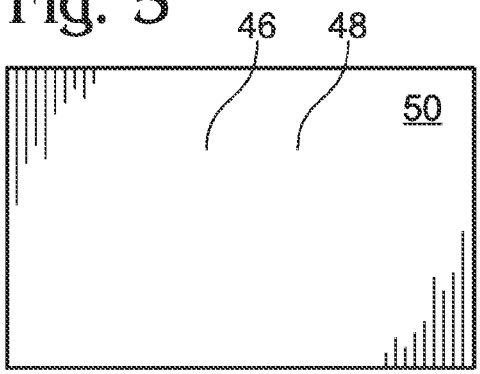
FIG. 5 is a plan view showing another embodiment of the article of FIG. 1.

An example of such an article is shown in FIG. 2 and includes a region 16 permeated with a first composition 18, and a second region 20 permeated with another composition 22. In FIG. 3, a plurality of regions 24-28 are shown, each permeated with a selected composition 30-34. It should be understood that the size and shape of articles 10 and the relative sizing and placement of the regions therein have been schematically shown in FIGS. 1-3 and may vary in actual implementation. For example, the compositions may be permeated into opposing sides of the article, and the article may also include a impermeable layer separating the regions into which the compositions are permeated. An example of such a construction is shown in FIG. 4, with article 10 including a barrier layer 35 separating sheets of material 38 and 40 on which one or more compositions 42 and 44 are permeated. As another example, a plurality of compositions 46 and 48 may be overlapped or otherwise permeated into the same region 50 of an article, such as shown generally in FIG. 5.

When permeating or otherwise applying the composition to the sheet, other substances, including inert materials or substances that are unrelated to the dry-cleaning effectiveness of the sheet, may be added as well. For example, the sheets may contain some percentage of filler or other material impregnated therein in addition to any of the compositions described herein. Such a sheet is still within the scope of the present invention, even though the percentage of a particular component of the composition may vary from those described above if considered in the context of the overall weight percentages of all materials permeated into the sheet. Similarly, adding an inert or filler material to the composition would still produce a composition within the scope of the present invention in that the weight percentages of the active components (i.e. organic solvents, water, surfactant, biocide, perfume, emulsifier, etc.) of the composition would still be within the ranges discussed herein.

Figure 6:
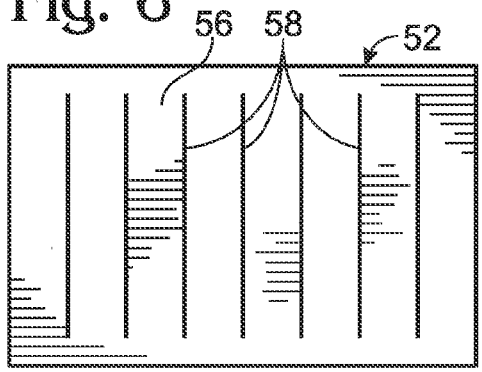
FIG. 6 is a plan view showing another embodiment of the article of FIG. 1.

The sheet is preferably formed from a pliable material that is absorbent to allow the substances to be permeated therein, and that is also not prone to deterioration in a dryer. Examples of suitable materials include a non-woven fabric, paper towel, fibrous batting or the like made from cotton, rayon, polyester fibers, wood pulp, open-cell foam, polypropylene and the like. The sheet may also include one or more slits that promote airflow through the sheet and contact between the sheet and the garment or garments being cleaned. For example, in FIG. 6, a sheet-like article is generally indicated at 52. The article includes one or more compositions, which are generally indicated at 54, and further includes a plurality of spaced-apart slits 56. The sheet may also be formed of a suitable material that disintegrates, or otherwise breaks into smaller pieces, when subjected to the operating conditions of a dryer, namely, the heat and/or tumbling action. With such a construction, the sheet will essentially disappear from the drying compartment and will be at least substantially collected in the lint filter of the dryer.

The sheets may be formed of any suitable shape and size. The sheet should be sufficiently large to absorb the desired quantity of the invented composition and to provide sufficient surface area to contact and effectively clean the garments being cleaned. Generally rectangular or square sheets have proven effective, although other shapes are certainly within the scope of the invention. Similarly, sizes in the range of approximately 10 and approximately 1000 square centimeters have proven effective, although larger and smaller sizes may be used. For example, 10.25" by 12" sheets have proven effective.

In practice, approximately 5-20 cubic centimeters of composition have proven effective, however, the quantity of composition permeated into the sheet may vary. For example, approximately ⅓ of an ounce (approximately 10 cubic centimeters) of composition has proven suitable for most applications. It should be understood that if the composition includes filler or other materials not directed to dry-cleaning, then a larger total volume may be necessary. When the sheet contains a general purpose composition and one or more application-specific compositions, the total volume of compositions permeated into the sheet will tend to be larger than if only a general purpose composition is used. It follows, that the size of the sheet may also tend to increase when more than one composition is to be permeated therein.

Figure 7:
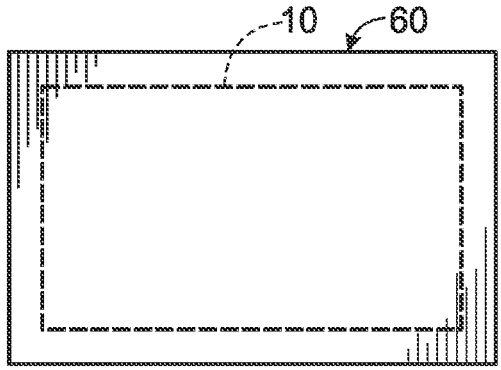
FIG. 7 is a plan view showing a packaged article according to the present invention.

A suitable method for producing the invented articles in larger quantities is to dispense one or more of the invented compositions from one or more perforated conduits onto a continuous sheet moving on a conveyor, for example, down a production line. The composition can be spread with a doctor's blade, a rod or other suitable device positioned closely to the sheet material downstream of the conduit with respect to the direction of movement of the sheet material in the production line. The composition is thus spread out so that it permeates or is otherwise applied to the sheet relatively uniformly. Alternatively, the composition can be provided to the conduit under pressure and sprayed through its perforations onto the sheet material as it advances along the conveyor. If the organic solvent and water are not mixed into a composition with an emulsifier, separate conduits and/or spray nozzles can be provided for the organic solvent, water and optionally also perfume and/or surfactant, and used to apply these substances to the same or different portions of the sheet. The elongated sheet then can be cut with a knife, die cutter or other suitable device adapted to cut the sheets into sections. After being sized, the sheets are preferably enclosed within a protective wrapper, and preferably a wrapper or enclosure that is at least substantially air-tight, such indicated generally at 60 in FIG. 7. Individual foil packets have proven effective, although resealable containers may be used as well, especially when more than one sheet are to be packaged together.

One method for using an article according to the present invention is to place the sheet directly into a dryer, such as in a household or laundromat, along with the garments that are to be dry-cleaned. The clothing is then tumbled with the sheet for 5 to 45 minutes in air heated to a temperature of 40°-90° Celsius. Tumbling the garments with the sheet for at least 15 minutes at an air temperature over 50° Celsius has proven effective. However, the optimum time and temperature may tend to vary, depending upon the number of garments to be cleaned and the precise dry-cleaning composition being used. Due to the action of the substances released from the sheet by the heat of the dryer as well as the contact of the sheet with the clothing during tumbling, the clothing is cleaned of oil-based stains such as body or cosmetic oils as well as water-soluble materials. After tumbling, the clothing can be removed from the drying machine and worn.

In some applications, it may be desirable to place the garments and sheet in a container to protect the garments from damage during the drying cycle. For example, garments with buttons and delicate lace could be damaged during the tumbling action of a conventional dryer. Preferably, the container is an air-permeable container that may be selectively sealed once the garments and sheet are inserted therein. For example, the container may be perforated or otherwise include vents to enable air flow to the garments to prevent or reduce wrinkling of the garments. Preferably, the vents or perforations are sized so that buttons and other portions of the garments are prevented from passing therethrough.

After placing the garment or garments and the sheet in the container, the container is then closed and placed inside of the drying machine. The container is tumbled inside of the drying machine under similar air temperature conditions and time durations as stated above with respect to the first invented method, to clean the clothing in the container. After tumbling in the drying machine, the container is removed from the machine and the container is opened to extract the clothing that is ready to be worn.

An example of a suitable container is a pliable bag formed from nylon or another suitable material that can withstand the elevated temperatures in the drying machine. So that clothing can be readily placed into or taken out of the bag, the bag preferably defines a sealable opening that can be closed with a drawstring, snaps, a zipper or any other mechanism for selective sealing of the bag to retain the garments and sheet therein. The bag may be used repeatedly or may be disposable.

As discussed, the invented composition may be used in larger and smaller quantities than those described above. Illustrative examples of larger and smaller quantity applications are described below.

The invented composition may also be used in commercial dryers for dry cleaning larger quantities of articles to be cleaned. For example, hotels, cruise ships and other establishments with high laundry and dry cleaning demands typically will have large-capacity commercial dryers. By "commercial dryers," reference is made to large-capacity dryers that are adapted to hold between approximately 40 to approximately 200 pounds of articles to be cleaned or more. Typically, these dryers operate at temperatures between approximately 100° C. and 200° C.

Figure 8:
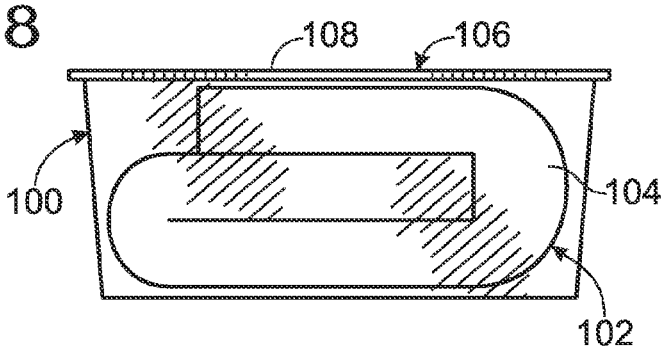
FIG. 8 is a schematic side elevation view showing another embodiment of a packaged article according to the present invention.
Figure 9:
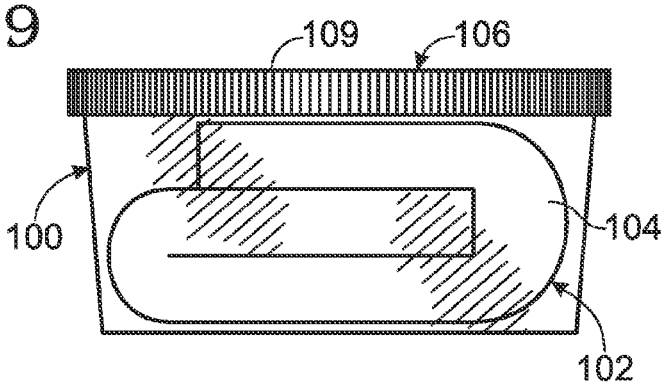
FIG. 9 is a schematic side elevation view showing a variation of the article of FIG. 8.

It should be understood that with such a larger capacity, the corresponding amount of the invented dry cleaning composition will also increase proportionately. Typically, an absorbent towel, such as the size of conventional hotel towels, should be of sufficient size and absorbency. The towel may be formed of any suitable absorbent material, including any of these discussed above. One method for using the invented composition for these commercial dryers is to sell the permeated towels prepackaged in an air-tight container. For example, in FIG. 8, a container 100 is shown housing a towel 102 permeated with the invented composition 104. As shown, the container has a sealable opening that is sealed with a closure 106. Closure 106 has either a single-use closure, such as a removable foil cover 108 (shown in FIG. 9), or a resealable closure, such as a threaded cap 109 (shown in FIG. 9). Other examples of suitable resealable closures include friction fit lids and baglike plastic containers that are sealed by pressing ribs into connection with each other, such as sold under the trade name ZIPLOCK™. In essence, this is a larger-scale version of the invented articles described above. As such, it should be understood that the towel may include any of the additional features described above and illustrated in the figures, such as multiple compositions, stain-specific compositions, slits, etc. In FIG. 8 and the subsequently described FIGS. 9-12, the containers are schematically illustrated as being generally rectangular transparent containers for purposes of illustration. It should be understood that any suitable size, shape and color of container may be used.

Figure 10:
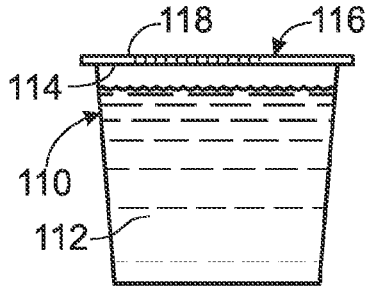
FIG. 10 is a schematic side elevation view showing another embodiment of a packaged article according to the present invention.
Figure 11:
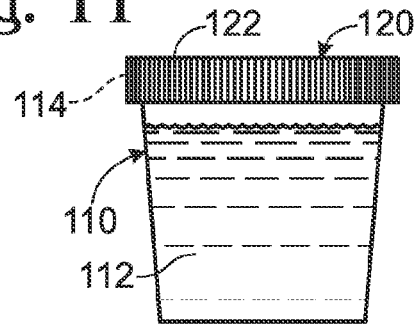
FIG. 11 is a schematic side elevation view showing a variation of the article of FIG. 10.

Another method for utilizing the invented composition for use in commercial dryers is to sell the composition in a liquid that can be applied to a towel in a premeasured, or measured onsite, volume. For example, defined volumes of the composition may be sold in prepackaged containers, such as shown in FIG. 10 and indicated generally at 110, Container 110 holds a volume of the invented composition 112 and includes a sealable opening 114. When container 110 is sized for a single use, in which the entire contents of the container will be applied to a towel, then opening 114 typically will be sealed with a single-use closure 116, such as a foil cover 118. Alternatively, container 110 may contain a sufficient volume of composition 112 for multiple uses, in which case the container should include a resealable closure 120, such as a threaded lid 122. An example of such a resealable container containing a sufficient volume of composition for multiple uses is shown in FIG. 11.

Figure 12:
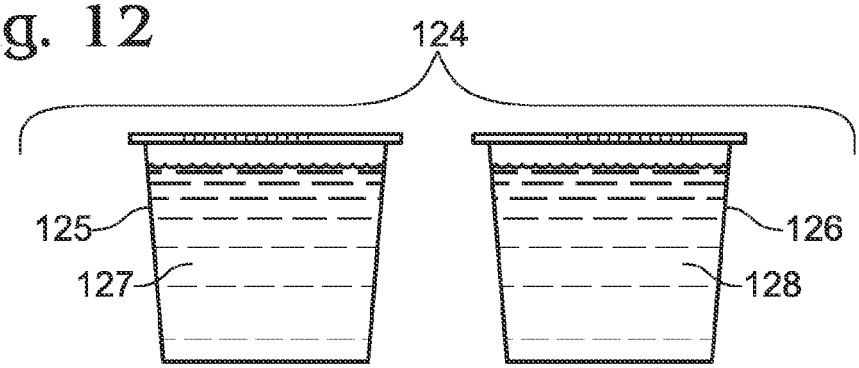
FIG. 12 is a schematic side elevation view showing another embodiment of a packaged article according to the present invention.

In some applications, the composition may contain components that are not mixed until it is time to use the composition. In such a situation, the composition will be sold in a plurality of single- or multi-use containers, such as those described above. An example of such a packaged article is shown in FIG. 12 at 124. As shown, article 124 includes a pair of containers 125 and 126 that respectively contain components 127 and 128 of a selected version of the invented composition. In a further variation, a selected one of the containers may contain the basic dry cleaning composition, while one or more other containers include application-specific compositions that may be selectively added when needed. Examples of these application-specific compositions, as described above, include sizing, moth repellents, UV inhibitors, brighteners, stain-specific compositions, water repellents, odor removers, fragrances, etc.

Figure 13:
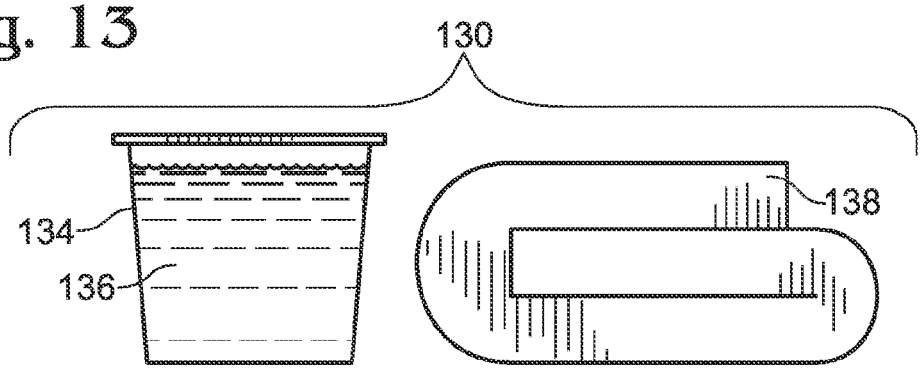
FIG. 13 is a schematic side elevation view showing another embodiment of a packaged article according to the present invention.

Regardless of the particular container, the composition in the container can be applied to a towel prior to use, and then the towel can be added to the dryer along with the articles to be dry cleaned. In a variation of this version, the prepackaged article 130 includes a supply of one or more premeasured containers 134 of composition 136 and one or more towels or other suitable sheets or absorbent media 138 to which the composition may be applied prior to use, such as shown in FIG. 13 (not necessarily to scale).

Figure 14:
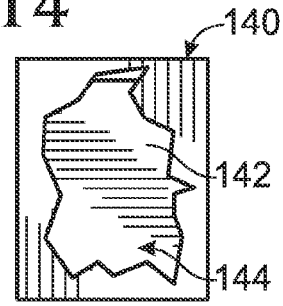
FIG. 14 is a fragmentary side elevation view showing another embodiment of a packaged article according to the present invention.
Figure 15:
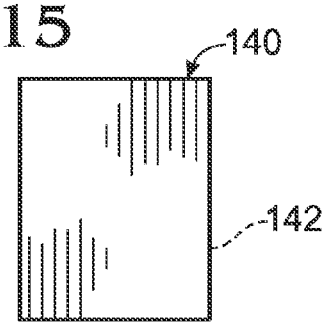
FIG. 15 is a schematic side elevation view showing a variation of the article of FIG. 14.

An example of an application for smaller quantities of the invented composition is a relatively small hand and object cleaner. Because the invented composition is safe and non-toxic, it may be safely applied to a user's hands and body. Similarly, because the organic-based composition is particularly well-suited for removing oil stains, it works well as a hand-cleaner, paint remover, etc. Therefore, the composition may be prepackaged in a relatively small single-use container, such as a sealed foil and/or plastic packet, or container, 140, such as shown in FIG. 14. Packet 140, which typically is a relatively small pouch approximately 1-3 inches on each side, or a relatively small single-use canister contains a quantity of the invented composition 142 impregnated on a towelette 144 of any suitable absorbent media, such as nonwoven sheets and others previously disclosed herein. Similar to conventional prepackaged towelettes, such as those sold under the brand name HANDI WIPES™, packets 140 may be readily carried by users, such as in their pockets, brief cases, purses, wallets, backpacks, etc. A variation of the packet is shown in FIG. 15. In this version, the packet contains a selected embodiment of the invented composition 142 without any towelette or other absorbent media. This version of the packet may be used, for example, as a hand cleaner that can be dispensed into a user's hands from the packet.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, is where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

INDUSTRIAL APPLICABILITY

The invented article, composition and methods are applicable to the dry-cleaning industry. More specifically, the invented articles, compositions and methods are applicable to dry-cleaning of clothing or other objects in dryers conventionally used with washing machines.

The invention claimed is:

1. A method for cleaning garments, the method comprising:

dispensing, from an internal chamber of a dispenser, a dry-cleaning composition onto a garment to be cleaned in a drying machine, wherein the garment to be cleaned is not suitable for laundering in a household washing machine, wherein the dispenser is adapted to selectively dispense the dry-cleaning composition directly onto the garment to be cleaned, wherein the dispenser is selected from the group consisting of an aerosol spray vessel, a pump-actuated spray vessel, and a pressurized spray vessel, wherein the dry-cleaning composition comprises active components that comprise at least one organic solvent, water, and at least one emulsifier;

placing into the drying machine the garment to be cleaned that contains the dry-cleaning composition dispensed from the dispenser, wherein the drying machine is a household-type, non-pressurized drying machine normally adapted to dry wet garments from a washing machine; and tumbling the garment to be cleaned that contains the dry-cleaning composition from the dispenser with heated air in the drying machine to clean the garment with the dry-cleaning composition, wherein the tumbling includes permitting the heated air in the drying machine to contact the garment to be cleaned as the garment to be cleaned is tumbled with the heated air in the drying machine.

2. The method of claim 1, wherein the dispensing occurs prior to the placing.

3. The method of claim 1, wherein the drying machine has a maximum operating temperature, and wherein the dry-cleaning composition has a flashpoint greater than the maximum operating temperature.

4. The method of claim 1, wherein the dry-cleaning composition includes at least 30 wt % water.

5. The method of claim 1, wherein the organic solvent includes at least one glycol.

6. The method of claim 1, wherein the emulsifier includes a surfactant.

7. The method of claim 6, wherein the surfactant includes a fluorosurfactant.

8. The method of claim 1, wherein the organic solvent includes at least one paraffin.

9. The method of claim 8, wherein the organic solvent further includes at least one glycol.

10. The method of claim 9, wherein the emulsifier includes a surfactant.

11. The method of claim 10, wherein the surfactant includes a fluorosurfactant.

12. The method of claim 10, wherein the organic solvent forms at least 35 wt % of the active ingredients.

13. The method of claim 1, wherein prior to tumbling the garment in the heated air in the drying machine, the method further includes placing the garment to be cleaned that contains the dry-cleaning composition from the dispenser into an air-permeable container through which the heated air may freely flow as the garment and the container are tumbled in the drying machine.

14. The method of claim 1, wherein the placing does not include placing the garment to be cleaned into a container that is placed into the drying machine with the garment to be cleaned.

15. A method for cleaning garments, the method comprising:

dispensing, from an internal chamber of a dispenser, a dry-cleaning composition onto a garment to be cleaned in a drying machine, wherein the garment to be cleaned is not suitable for laundering in a household washing machine, wherein the dispenser is adapted to selectively dispense the dry-cleaning composition directly onto the garment to be cleaned, wherein the dispenser is selected from the group consisting of an aerosol spray vessel, a pump-actuated spray vessel, and a pressurized spray vessel, wherein the dry-cleaning composition comprises active components that comprise at least one organic solvent, water, and at least one emulsifier;

placing into the drying machine the garment to be cleaned that contains the dry-cleaning composition dispensed from the dispenser, wherein the drying machine is a household-type, non-pressurized drying machine normally adapted to dry wet garments from a washing machine;

placing, with the garment to be cleaned containing the dry-cleaning composition dispensed from the dispenser, a flexible treatment sheet containing a sheet-dispensed dry-cleaning composition containing active components, wherein the active components include at least one organic solvent that comprises at least 50% of the active components in the sheet-dispensed dry-cleaning composition; and tumbling the flexible treatment sheet and the garment to be cleaned that contains the dry-cleaning composition from the dispenser with heated air in the drying machine to clean the garment with the dry-cleaning composition, wherein the tumbling includes permitting the heated air in the drying machine to contact the garment to be cleaned as the garment to be cleaned is tumbled with the heated air in the drying machine.

16. The method of claim 1, wherein the active components include a dewrinkler and an odor-removing substance.

17. The method of claim 1, wherein the active components further include at least one stain remover adapted to remove one or more of ink, rust, and red wine.

18. A method for cleaning garments, the method comprising:

dispensing, from an internal chamber of a dispenser, a dry-cleaning composition onto a dry garment to be cleaned, wherein the garment to be cleaned is not suitable for laundering in a household washing machine, wherein the dispenser is adapted to selectively dispense the dry-cleaning composition directly onto the garment to be cleaned, wherein the dispenser is selected from the group consisting of an aerosol spray vessel, a pump-actuated spray vessel, and a pressurized spray vessel, wherein the dry-cleaning composition comprises active components that comprise at least one organic solvent, water, a dewrinkler, and an odor-removing substance;

placing into a drying machine the dry garment to be cleaned that contains the dry-cleaning composition dispensed from the dispenser, wherein the drying machine is a household-type, non-pressurized drying machine normally adapted to dry wet garments from a washing machine; and tumbling the dry garment to be cleaned that contains the dry-cleaning composition from the dispenser with heated air in the drying machine to clean the dry garment with the dry-cleaning composition, wherein the tumbling includes permitting the heated air in the drying machine to contact the dry garment to be cleaned as the dry garment to be cleaned is tumbled with the heated air in the drying machine.

19. The method of claim 18, wherein the at least one organic solvent includes a paraffin, the dry-cleaning composition comprises at least approximately 30 wt % water, and the dry-cleaning composition further comprises a surfactant.

20. The method of claim 19, wherein the surfactant includes an emulsifier.

21. The method of claim 19, wherein the surfactant includes a fluorosurfactant.

22. The method of claim 18, wherein the method further includes placing, with the dry garment to be cleaned containing the dry-cleaning composition dispensed from the dispenser, a flexible treatment sheet containing a sheet-dispensed dry-cleaning composition containing active components, wherein the active components include at least one organic solvent that comprises at least 50% of the active components in the sheet-dispensed dry-cleaning composition.

* * * * *